United States Patent [19]

Stull

[11] 4,425,839

[45] Jan. 17, 1984

[54] FLEXIBLE AIRDUCT AND DEFLECTOR SYSTEM

[76] Inventor: W. John Stull, 707 Monroe St., Endicott, N.Y. 13760

[21] Appl. No.: 203,541

[22] Filed: Nov. 3, 1980

Related U.S. Application Data

[63] Continuation of Ser. No. 10,603, Feb. 8, 1979, abandoned.

[51] Int. Cl.[3] ..... F24F 7/00; A47G 5/00

[52] U.S. Cl. ..... 98/40 R; 98/40 D; 98/31; 160/351

[58] Field of Search ..... 98/31, 37, 50, 54, 55, 98/40 D, 40 R; 52/2; 160/350, 351; 181/295, 284

[56] References Cited

U.S. PATENT DOCUMENTS

| | | | |
|---|---|---|---|
| 3,626,837 | 12/1971 | Pelosi | 98/40 D X |
| 3,747,503 | 7/1973 | Lovell | 98/50 |
| 3,972,272 | 8/1976 | Bagby | 98/50 |
| 4,023,372 | 5/1977 | Presler et al. | 98/50 |
| 4,103,598 | 8/1978 | Cooper | 98/31 |

*Primary Examiner*—Albert J. Makay

*Assistant Examiner*—Henry Bennett

*Attorney, Agent, or Firm*—Charles S. McGuire

[57] ABSTRACT

An air conditioning or heating duct system for insulation in raised floor or dropped ceiling environments includes a strip of flexible material, such as foam rubber or the like, having a width approximately equal to the distance between a sub floor and a raised floor or between a main ceiling and a drop ceiling and having a length determined by the path that the cooled or heated air must follow throughout the raised floor or dropped ceiling area. The flexible strips are fastened by U-shaped brackets where the conditioned air enters or leaves the space which is to be heated or cooled, with additional brackets positioned at points where bends in the flexible materials are made. A system according to the present invention may either include double-spaced apart strips of flexible material to form air ducts or it may include a single strip of flexible material to direct or deflect the cooled or heated air into a first portion of a space to be controlled and not into a second portion of a space to be controlled. Additional shorter strips of flexible material may be placed throughout the area to be cooled or heated to direct or deflect the cooled or heated air to or away from specific portions of the area.

5 Claims, 5 Drawing Figures

FLEXIBLE AIRDUCT AND DEFLECTOR SYSTEM

This is a continuation of application Ser. No. 010,603, filed Feb. 8, 1979, now abandoned.

BACKGROUND OF THE INVENTION

1. Field of the Invention

The present invention relates to an air duct system for air conditioning or heating and more particularly an air duct system employing flexible materials to form duct side walls in raised floor and lowered ceiling environments.

2. Description of Prior Art

In the prior art, there are various patents which relate to ducting systems generally.

U.S. Pat. No. 2,595,408 discloses a flexible pipe used for irrigation systems. However, the pipe disclosed in the patent is of cylindrical construction and is not adapted to duct air or deflected air in dropped ceiling and raised floor environments.

U.S. Pat. No. 2,551,751 discloses an air conditioning conduit which is pliable and which is designed 14 for installation in older buildings for moving cooled air from a source to a room to be cooled. The pliable conduit disclosed in this patent, like the flexible pipe of U.S. Pat. No. 2,595,408, forms a complete enclosure and does not contemplate using the sub floor and raised floor as top and bottom of a conduit, nor does it contemplate the use of a single strip of flexible material as an air deflector for directing heated or cooled air to a desired area to be conditioned.

Another example of the prior art is showed in U.S. Pat. No. 2,352,876, in which sections of collapsable fire-resistent corrugate board is used to form ducting for heated air. As with the prior patents discussed above, this patent does not contemplate applicant's invention.

Another patent having a similar construction to U.S. Pat. No. 2,353,876 is U.S. Pat. No. 3,078,880, which discloses a folding insulated duct. Again the duct is the complete enclosure of generally rectangular shape, having portions formed so as to be assembled with edges of the preformed ducting having made in portions.

U.S. Pat. No. 3,759,159 shows a ventilating air distributing duct system employing fiberglass sections as wall members of the ducts for installation in drop ceiling applications. The system disclosed in the patent requires an enclosed duct system for air distribution and requires a very complex support structure neither of which are required by applicant's invention.

U.S. Pat. No. 2,887,733 describes a system for distributing heated air in a mobile home application wherein blankets of insulation formed in U-shaped members by heating air ducts within the mobile home. The duct system shown in the patent requires a firm support box shown in FIG. 3 of the patent as elements 12, 13, and 14, to support the U-shaped insulation blanket to form the heating duct. Further, a channel member 16 is contained within the insulated channel to actually carry the heated air. The structure of the patent is much more complex and expensive then the structure of an embodiment of applicant's invention. Further, as with the previous prior art patents discussed this patent does not contemplate the use of a single strip of flexible material to provide cold or warm air direction and deflection in an enclosed environment such as a raised floor or dropped ceiling application. Each of the prior art patents described above, contains one or more disadvantages relative to use in an enclosed environment such as a raised floor or dropped ceiling application. Each of the systems described in those patents are expensive and require complex support mechanisms.

SUMMARY OF THE INVENTION

Therefore, it is an object of the present invention to direct the flow of conditioned air in an enclosed environment such as a raised floor or dropped ceiling application by means of an air direction and deflection system, which includes one or more strips of flexible material arranged within the enclosed environment to direct the conditioned air to required locations and to prevent the flow of conditioned air to areas not requiring heating or cooling.

It is another object of the present invention to direct the flow of conditioned air in an enclosed environment by means of strips of flexible material which are mounted to a floor or ceiling by brackets of sufficient width to accommodate the flexible material and sufficient length to properly support the flexible material along its length.

Yet another object of the present invention is to form ducts for conditioned air, wherein the ducts are formed by a top and bottom of an enclosed environment such as a sub floor and a raised floor or a main ceiling and a drop ceiling and the side walls of the duct are formed by flexible strips of insulating material, each of the flexible strips being of sufficient height to match the separation between the sub floor and the raised floor or between the main ceiling and the drop ceiling.

Yet another object of the present invention is to direct the flow of conditioned air as above, by a flexible duct system having one or more openings to provide for air flow of selected areas to be conditioned.

Accordingly, a system for directing the flow of conditioned air in an enclosed environment includes one or more elongated strips of flexible material forming one or more walls for directing the flow of conditioned air within a selected area. The height of the flexible material strips is selected based upon the height of the controlled environment in which the strips shall be employed. The length of the elongated flexible strips is selected based upon the path that the conditioned air is desired to be directed. The elongated strips of flexible material are mounted by the first or second brackets, the first brackets being longer to support ends of the flexible strips, or long runs of flexible strips and be second mounting brackets being adapted to support the elongated flexible strips and to form bends in the flexible strip to control the direction of conditioned air.

It is an advantage of the present invention that conditioned air paths in a raised floor or dropped ceiling environment may be constructed inexpensively and quickly by the use of flexible material strips such as foam rubber strips or similar material, saving the cost of labor as well as material costs over prior art ducting systems.

These and other objects of the present invention will become immediately apparent from the following detailed description in conjunction with the accompanying drawing.

DETAILED DESCRIPTION OF A PREFERRED EMBODIMENT OF THE INVENTION

Figure 1:
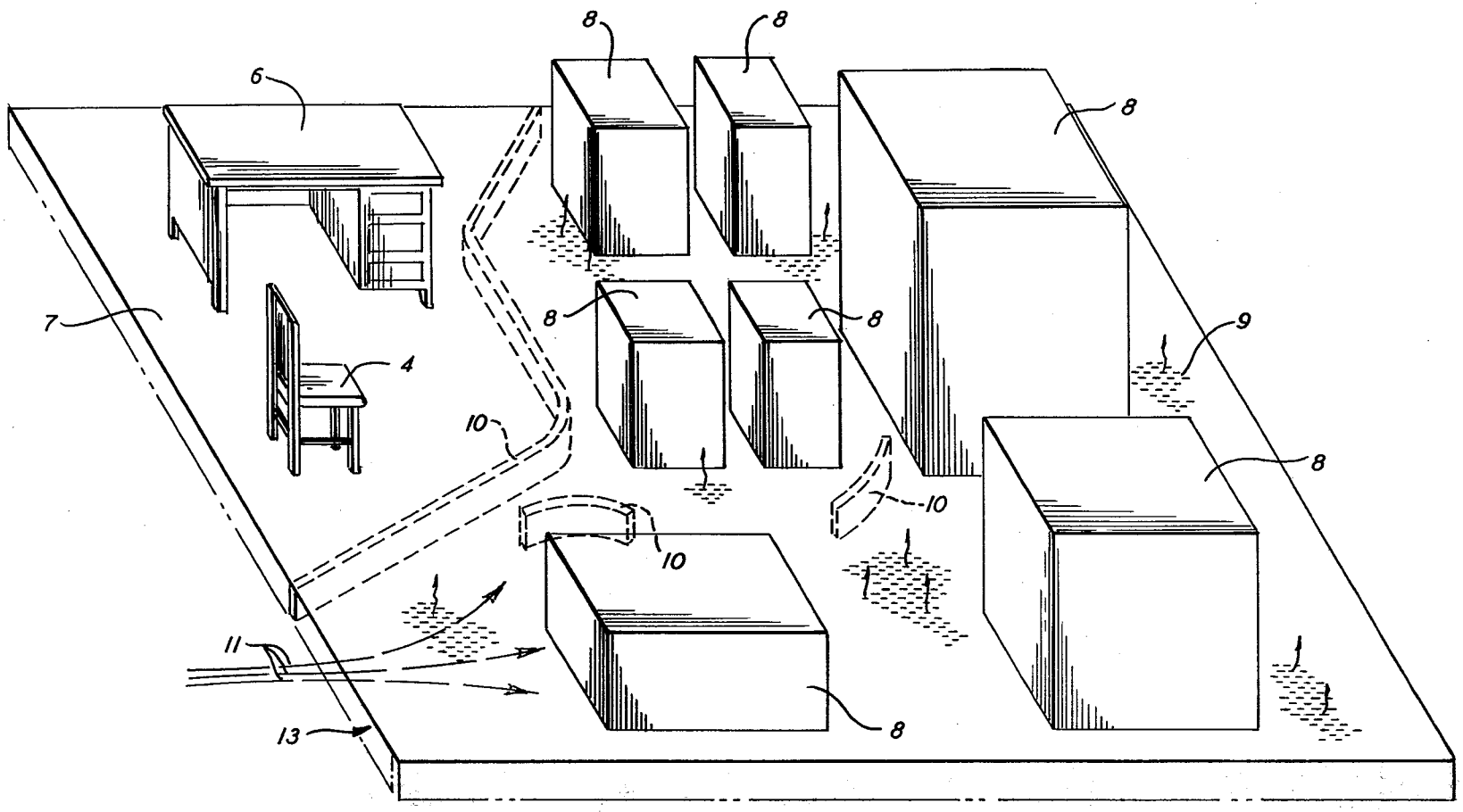
FIG. 1 is an isometric view of an area employing an air direction and deflection system according to the present invention.

Referring now to FIG. 1, an area is shown in which the first portion, 7, containing furniture such as chair 4 and desk 6, are used for human occupation. Area 7 is to be heated or cooled by a common central heating or air conditioning system and area 7 does not require additional air conditioning such as might be required for equipment modules 8 contained in area 9. It is common to have supplied cooling air to absorb high amounts of heat generated by equipment modules such as equipment modules 8. Flexible duct 10 has a first portion which forms a wall between the area 7 for human occupation and area 9 where the heat generating modules 8 are located. This flexible wall allows for comfortable working environment for the humans while permitting the removal of heat generated by the equipment modules 8. Additionally, short segments of flexible duct 10 are placed at predetermined locations within area 9 for deflecting and directing the cooling air to specific units of equipment modules 8. Conditioned air 11 enters through opening 13 in the enclosed environment such as a raised floor in area 9. Conditioned air 11 passes through perforations in raised floor 20 and absorbs heat generated by equipment modules 8 in area 9. The flow of conditioned air 11 is substantially vertical through the heat-generating equipment modules. Exhaust air 15, having absorbed heat generated by equipment modules 8 exits through openings in the ceiling or in the walls of the controlled area near the ceilings. These openings are not shown since they are not a significant part of the present invention.

It should be understood that although the embodiment described in respect to FIG. 1 has been described relative to a cooling system, the principle of applicant's invention apply equally to an environment in which the input air is at a temperature higher than ambient for the purpose of heating an area, rather than cooling an area.

Figure 2:
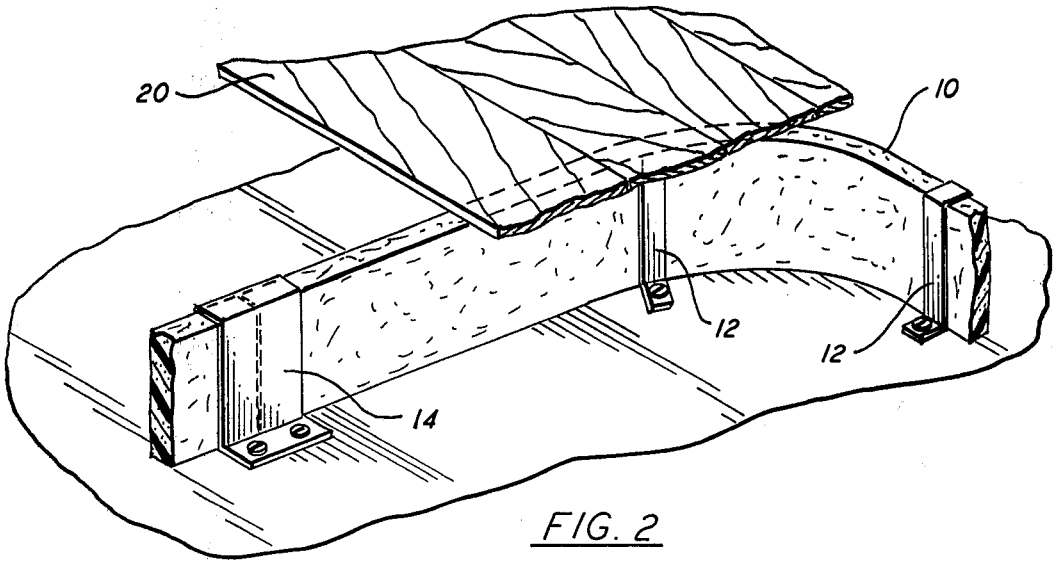
FIG. 2 is an isometric view of a section of a flexible duct wall in an enclosed environment according to the present invention.

Referring now to FIG. 2, an isometric section view of a portion of a flexible duct wall 10 is shown between raised floor 20 and sub floor 30. Curves in duct wall 10 are formed and the duct wall 10 is held in place by one or more small brackets 12, whereas joints wherein two pieces of duct material are butted together are held in place by one of larger brackets 14. Brackets 14 are also used at the entrances and exits to an enclosed area to hold the flexible duct material 10 in proper position. Brackets 12 may also be used at entrances and exits to a controlled area or adjacent to cuts in the flexible duct wall 10 made to fit snugly around obstacles such as conduit contained within the raised floor area. Brackets 12 and 14 may be constructed of sheet metal of 18 gauge or larger, depending upon the requirements of the specific application.

Figure 3:
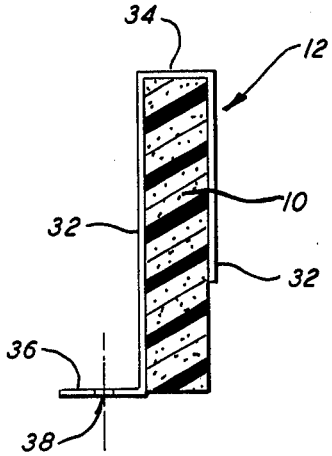
FIG. 3 is a cross section end view of the portion of the flexible duct wall according to the present invention.

Referring now to FIG. 3, an end cross section view of a duct wall according to the present invention will be described. A flexible duct wall material 10, such as foam rubber, or other flexible material which will properly contain either cooled or heated air as required, is selected to have a height equal to the distance between raised floor 20 and sub floor 30 and a width sufficient to insure that the control air will not pass outside the area that the duct defines.

Bracket 12 is a simple U-shape member having sides 32 for supporting the duct material 10, a top portion 34 and a bottom portions 36 which extend outwardly along the sub floor 30 for attachment thereto and for lateral support. The bracket is mounted to sub floor 30 by bolts or other fasteners through holes 38 in legs 36.

Figure 4:
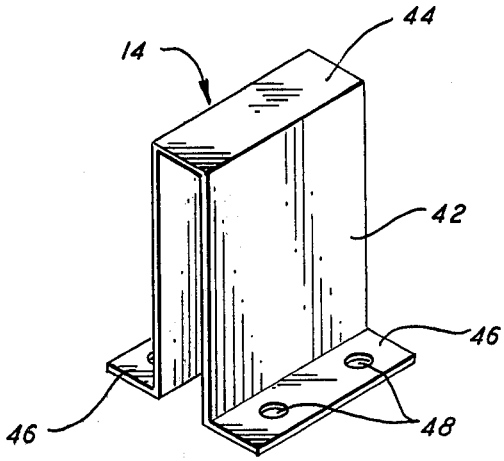
FIG. 4 is an isometric view of a mounting bracket according to the present invention.

Referring now to FIG. 4, end bracket 14 is shown with a side wall width somewhat greater than bracket 12. The side length 42 of bracket 14 is adapted to provide significantly greater lateral support for butting ends of flexible material 10 together and for holding the ends of flexible material at entrance and exit points of an area in a controlled environment. Bracket 14 includes sides 42 of a height selected to match the distance between the raised floor 20 and the sub floor 30, a width 44 selected to match the width of flexible material 10 and mounting legs 46 for lateral support of the duct wall, mounting legs 46 having holes 48 therein for mounting the bracket 14 to sub floor 30.

Figure 5:
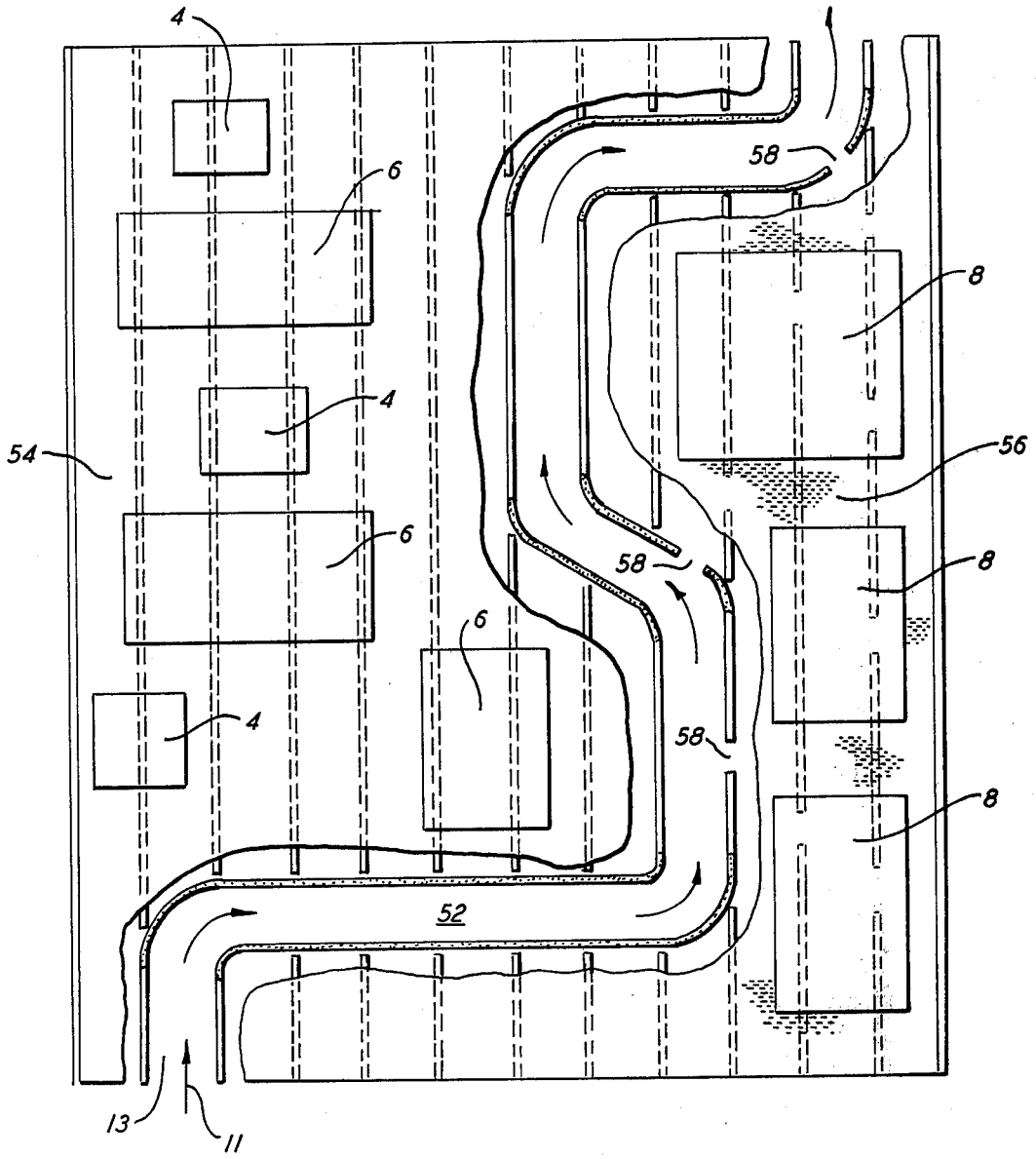
FIG. 5 is a top section view of a duct system according to the present invention.

Referring now to FIG. 5, an area 50 includes duct 52 passing from inlet 13 to outlet 57. Condition air 11 enters at input 13 and travels through duct 52 to outlet 57. Since the conditioned air may absorb heat from the area in a cooling situation or give off heat in a heating situation, air 15 exiting at output 57 will be of a different character (either hotter or cooler, depending upon whether the conditioned air is absorbing heat from heat-generating equipment in the cooling system, or the conditioned air is supplying heat to an area to be heated than the input flow 11. It should be noted that duct 52 passes through area 50 avoiding area 54 containing human work areas and furniture 4 and 6. Duct 52 may have openings 58 therein, to allow cooling air to pass under area 56 which contains the heat generating equipment modules 8. Raised floor 20 has perforations therein to allow the conditioned air to pass from duct 22 through openings 58 and performations in raised floor 20 to area 56 where a substantially vertical flow of cooling air passes through heat-generating equipment modules 8 absorbing heat therefrom and exiting the controlled area at the ceiling or near the tops of the walls.

It should be understood that a duct system according to the present invention may be constructed of material which is less expensive than currently used sheet metal duct work, also that in many applications less material is required and the cost of labor for installing the flexible duct work is significantly less than the cost of labor for installing common sheet metal cooling and heating ducts.

Although a preferred embodiment of the invention has been described, it will be apparent to those skilled in the art that there are many variations and modifications which may be made without departing from the spirit or scope of the invention. Therefore, the invention is not to be limited by the specific disclosure of a preferred embodiment herein, but only by the appended claims.

What is claimed is:

1. An air distribution system for introducing thermally conditioned air upwardly throughout only a specified portion of the floor area of a room, thereby creating a desired temperature differential between that part of said room above said specified portion of the floor area and the remaining part of said room above that portion of the floor area other than said specified portion, said system facilitating fast and simple selective adjustment of the portion of said floor area comprising said specified portion, said system comprising:

(a) flooring means defining the lower horizontal surface of said room;

(b) sub-flooring means arranged below and in spaced relation to said flooring means to define a space separated from the lower side of said room by said flooring means;

(c) a plurality of small, closely spaced openings extending through said flooring means over substantially the entire area thereof through which said space communicates with said room;

(d) at least one elongated, flexible, resilient element arranged within said space along a predetermined path and extending between said sub-flooring and said flooring means to separate said space into a first area, below said specified portion of said floor area, and a second area below said portion other than said specified portion;

(e) means securing said element to said sub-flooring means to define said predetermined path; and (f) means for introducing a supply of thermally conditioned air into said first area of said space, whereby said conditioned air may pass from said space into said room only through the openings in said flooring means within said specified portion of the area thereof.

2. The invention according to claim 1 wherein said resilient element is formed of a foam material.

3. The invention according to claim 2 wherein said material is foam rubber.

4. The invention according to claims 1 or 3 wherein said predetermined path is curved.

5. The invention according to claims 1 or 3 including at least two of said elements in spaced relation to one another to define said first area therebetween.

* * * * *